US005591043A

United States Patent [19]

Kenney

[11] Patent Number: 5,591,043

[45] Date of Patent: Jan. 7, 1997

[54] CORD HOLDING ATTACHMENT FOR ELECTRICAL RECEPTACLE

[76] Inventor: Cory Kenney, P.O. Box 330, Hardin, Mont. 59034

[21] Appl. No.: 393,393

[22] Filed: Feb. 23, 1995

[51] Int. Cl.[6] ..... H01R 13/62

[52] U.S. Cl. ..... 439/373

[58] Field of Search ..... 439/366, 367, 439/368, 369, 370, 371, 372, 373

[56] References Cited

U.S. PATENT DOCUMENTS

| | | | |
|---|---|---|---|
| 1,749,623 | 3/1930 | Zinman | 439/484 |
| 2,659,059 | 11/1953 | Johnson | 439/373 |
| 2,728,058 | 12/1955 | Phalen | 439/373 |
| 3,656,083 | 4/1972 | Brook | 439/373 |
| 4,045,108 | 8/1977 | Olsen | 439/323 |

FOREIGN PATENT DOCUMENTS

| | | | |
|---|---|---|---|
| 0507440 | 6/1939 | United Kingdom | 439/371 |

*Primary Examiner*—Hien D. Vu
*Attorney, Agent, or Firm*—H. Jay Spiegel

[57] ABSTRACT

A cord holding attachment for an electrical receptacle is disclosed in two embodiments. In a first embodiment, the cord holding attachment consists of a flat, flexible device designed to be installed under the electrical receptacle cover and having two pairs of laterally disposed wing-like structures. Each of the wing-like structures has a slot designed to allow receipt of an electrical conductor adjacent the male plug end. The wing-like structures may be folded toward one another and may be attached to the electrical conductor adjacent the male plug to retain the male plug interconnected in the female receptacle portion of the electrical receptacle. In a second embodiment, the wing-like structures are replaced with thinner, elongated strips which are reinforced with wires which are embedded in the strips and in the main portion of the device which is mounted behind the electrical receptacle cover. The strips may be wound about an electrical conductor plugged into the electrical receptacle to retain it in "plugged-in" configuration.

15 Claims, 3 Drawing Sheets

CORD HOLDING ATTACHMENT FOR ELECTRICAL RECEPTACLE

BACKGROUND OF THE INVENTION

The present invention relates to an improved cord holding attachment for electrical receptacle. In the prior art, electrical cord holding devices are known and have been incorporated in or attached to existing electrical receptacles. However, Applicant is unaware of any such device which includes all of the features and aspects of the present invention.

The following prior art is known to Applicant:

U.S. Pat. No. 2,084,953 to Gibson discloses a cord holding attachment for an electrical receptacle cover which includes a pair of metallic wings having slots and openings designed to receive a portion of an electrical conductor attached to the male plug end which is plugged into the electrical receptacle. The present invention differs from the teachings of Gibson as contemplating the use of flexible, wing-like structures or strips which may be folded toward one another to engage the electrical conductor and to hold it in retained position.

U.S. Pat. No. 3,499,103 to Pearce discloses a flexible cord attachable to an electrical conductor plugged into a receptacle and which flexible cord is attached to the middle of the receptacle cover. The present invention differs from the teachings of Pearce as contemplating a device mountable under the receptacle cover and having laterally extending wings or strips which may be folded toward the center of the receptacle cover to engage the electrical conductor plugged therein.

U.S. Pat. No. 3,708,778 to McKeever discloses a wall clamp for electrical cords which includes a device designed to receive a portion of the electrical conductor therein to provide slack. The McKeever device is solid and non-resilient. The present invention differs from the teachings of McKeever as contemplating a flexible device which may be folded to a position in engagement with an electrical conductor.

U.S. Pat. No. 4,066,313 to von dem Hagen discloses a safety guard for electrical plugs which is added on to the front of an electrical receptacle cover and includes a slot designed to receive an electrical conductor therein. The present invention differs from the teachings of von dem Hagen as contemplating a flexible device extending laterally from the sides of a receptacle cover and including flexible wings or strips designed to be foldable toward the center of the electrical receptacle cover to engage the electrical conductor plugged therein.

U.S. Pat. No. 4,702,709 to Santilli discloses a cover plate plug retainer which includes a pivoting C-shaped arm about which an electrical conductor may be wrapped or, in another embodiment, including a clip to which an electrical conductor may be releasably attached. The present invention differs from the teachings of Santilli as contemplating a device including flexible wings or strips extending laterally of the receptacle cover and which may be folded over toward the center of the receptacle cover to engage electrical conductors plugged therein.

U.S. Pat. No. 5,011,427 to Martin discloses a cord protector consisting of a two piece structure made of non-resilient material and including slots designed to receive electrical conductors to retain the associated male plugs in installed position within the electrical receptacle. The present invention differs from the teachings of Martin as contemplating a device including flexible wing-like structures or strips designed to be foldable toward the center of the electrical receptacle cover to retain electrical conductors in mounted position.

U.S. Pat. No. 5,158,476 to Kirby discloses a modular strain relief device for electrical connectors including two L-shaped solid members designed to facilitate the wrapping of an electrical conductor thereabout. The present invention differs from the teachings of Kirby due to its flexible nature and the use of lateral wing-like structures or strips which may be folded into engagement with an electrical conductor to retain it in mounted position in an electrical receptacle.

SUMMARY OF THE INVENTION

The present invention relates to an improved cord holding attachment for electrical receptacle. The present invention includes the following interrelated objects, aspects and features:

(A) In a first embodiment of the present invention, the inventive cord holding attachment consists of a flexible plate-like member having two pairs of elongated wings extending laterally outwardly therefrom. Each of these wings has a narrow slot therein which leads to a generally circular opening. Each of these slots is designed to receive an electrical cord therethrough which thence travels to the opening where it is retained therein. The inventive cord holding attachment is designed to be mounted on a wall over a double (i.e. duplex) electrical receptacle and to be clamped at that location by the usual electrical receptacle cover. For this purpose, the improved cord holding attachment device has an opening therethrough designed to be aligned with a threaded opening in the electrical receptacle designed to receive a screw extending through a corresponding opening in the electrical receptacle cover. In this way, the cord holding attachment may be clamped in place.

(B) In use, an electrical cord having a male plug attached at an end thereof is attached to the electrical receptacle with the male plug being received in a female coupling of the electrical receptacle. In such orientation, with the electrical cord extending away from the electrical receptacle, one pair of the wing-like structures of the cord holding attachment may be folded toward the center of the electrical receptacle cover and the respective slots and openings may be manipulated so that the electrical cord is held in the respective openings of the wing-like structures. In this way, the electrical cord and male receptacle thereof are retained against inadvertent or unintentional removal, even partial removal. Thus, the bare conductors of the male plug are precluded from exposure thereby preventing shocks and short circuits.

(C) In a second embodiment of the present invention, the wing-like structures are replaced with thinner strips which are reinforced with wires which extend from a central portion shaped similarly to the shape of the electrical receptacle cover and designed to be mounted thereunder. These wires reinforce the elongated, laterally extending strips and allow them to be bent toward the center of the electrical receptacle cover where they may be wound about an electrical cord attached to a male connector received in the electrical receptacle, to hold the electrical cord in place against inadvertent or unintentional removal of the male plug from the electrical receptacle.

As such, it is a first object of the present invention to provide an improved cord holding attachment for electrical receptacle.

It is a further object of the present invention to provide such a device including a first embodiment having flexible, wing-like structures extending laterally outwardly therefrom.

It is a still further object of the present invention to provide such a device in a second embodiment thereof having laterally outwardly extending strips which are reinforced with wires.

It is a yet further object of the present invention to provide such a device wherein in both embodiments thereof the device aids in retaining an electrical cord having a male end received within a female receptacle of an electrical receptacle device mounted in a wall.

It is a still further object of the present invention to provide a device which can be adapted to any number of plug sizes and will prevent the inadvertent removal of plugs of different sizes from their respective outlets.

It is a yet further object of the present invention to provide a device with easily modifiable shapes to fit most, if not all, shapes of receptacles, foreign and domestic, presently in use without changing the basic cord keeping characteristics thereof.

It is a still further object of the present invention to provide a device that holds the male plug head firmly into place in the female receptacle and prevents partial unplugging of the electrical connection which would expose bare conductors, and thus prevents potentially dangerous electrical shorts and shocks to users.

It is a further object of the present invention to provide a device that is cheaper and easier for laymen to install and use than is the case with currently available devices.

It is a further object of the present invention to provide such a device that uses wings, slots and holes to enclose the electrical connection and thereby isolate it from prying fingers.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
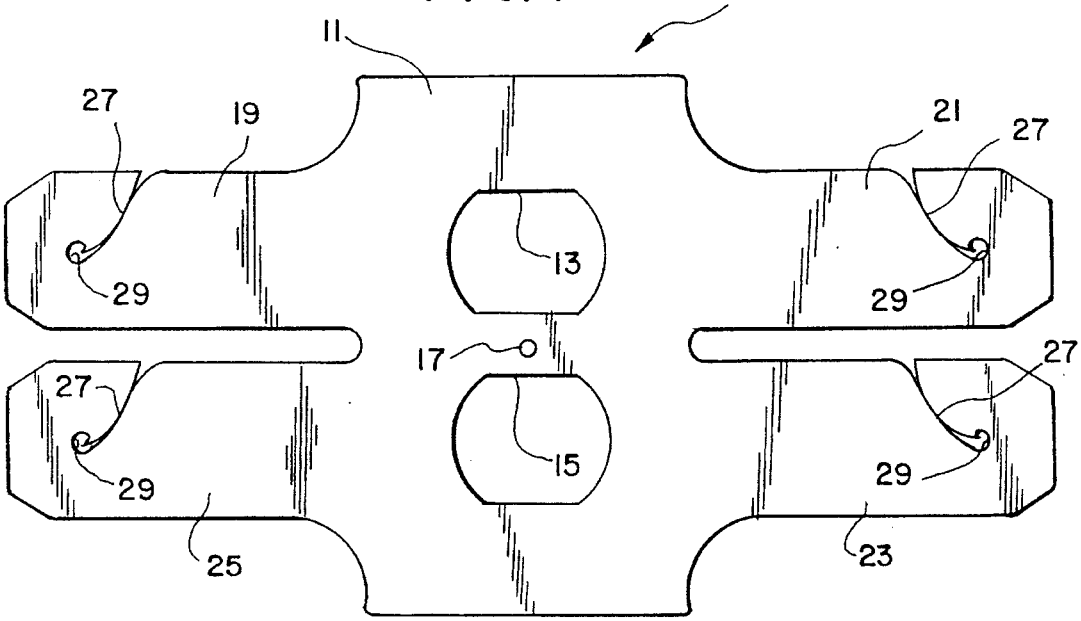
FIG. 1 shows a front view of a first embodiment of the present invention.

With reference, first, to FIG. 1, a first embodiment of the inventive cord holding attachment is generally designated by the reference numeral 10 and is seen to include a body 11 having a shape generally resembling that of a receptacle cover for a double electrical receptacle. As shown, the body includes openings 13 and 15 designed to be aligned, respectively, with female receptacles of the electrical receptacle device so as to avoid obstructing access thereto. The body 11 also includes a mounting screw opening 17 designed to be aligned with the opening in the electrical receptacle cover and the threaded opening within the electrical receptacle to permit a threaded fastener to extend therethrough to fasten the electrical receptacle cover over the inventive device 10.

With further reference to FIG. 1, it is seen that flexible, laterally extending wing-like structures or appendages 19, 21, 23 and 25 are provided extending laterally outwardly from the body 11. Each of these wing-like structures includes an elongated slot 27 leading to a generally circular opening 29. In the preferred embodiment of the present invention, the inventive device 10 is made of a material such as flexible, plastic sheeting or thin, rubber material. One example of a material suitable for use in making the inventive device 10 consists of 20 gauge plastic sheeting. The plastic sheeting may be made of any desired material or, if desired, may be made transparent or translucent.

Figure 2:
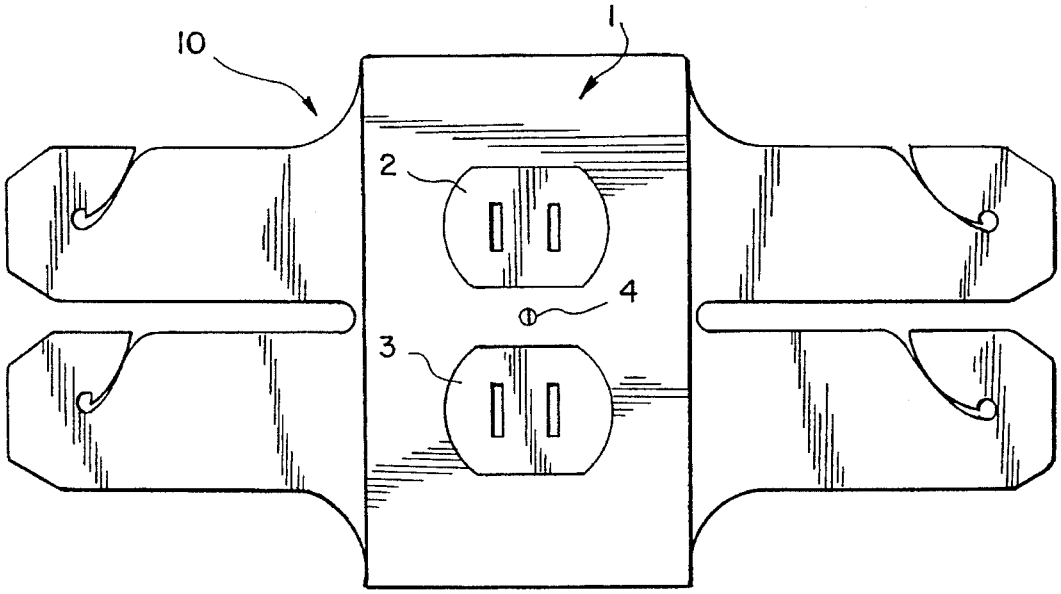
FIG. 2 shows a further front view of the first embodiment with an electrical receptacle cover plate mounted thereover.

With reference, now, to FIG. 2, the inventive cord holding attachment 10 is seen as mounted in an electrical receptacle with the electrical receptacle cover 1 seen to be overlying the body 11 (not shown in FIG. 2) of the device 10. Of note in FIG. 2 are the female receptacles 2 and 3 as well as the threaded fastener 4 which, as explained above, extends through the opening 17 in the body 11 of the cord holding attachment 10 and thence into a threaded opening (not shown) in the electrical receptacle.

Figure 3:
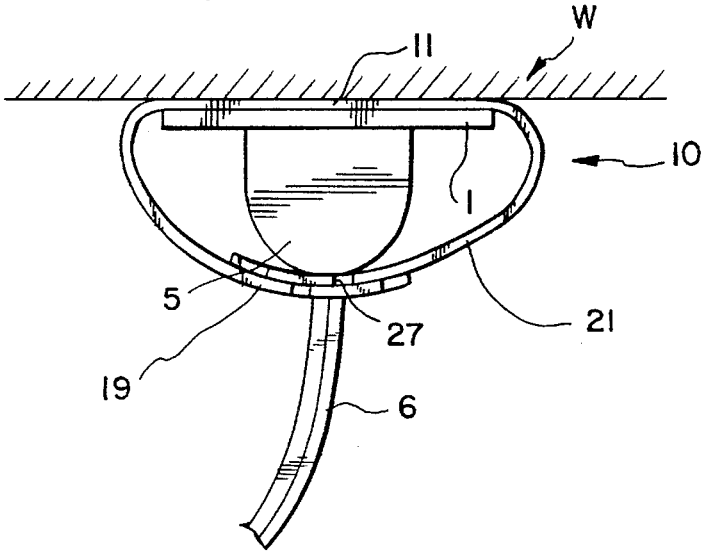
FIG. 3 shows a top view of the view of FIG. 2, but with portions of the inventive cord holding attachment folded in overlapping fashion about an electrical conductor.

FIG. 3 shows a wall W from above and shows the inventive device 10 in mounted position as shown in FIG. 2 with the electrical receptacle cover 1 thereover. A male plug 5 is seen inserted within the female receptacle 2 and has electrically connected thereto and extending therefrom a double wire electrical cord 6.

Figure 4:
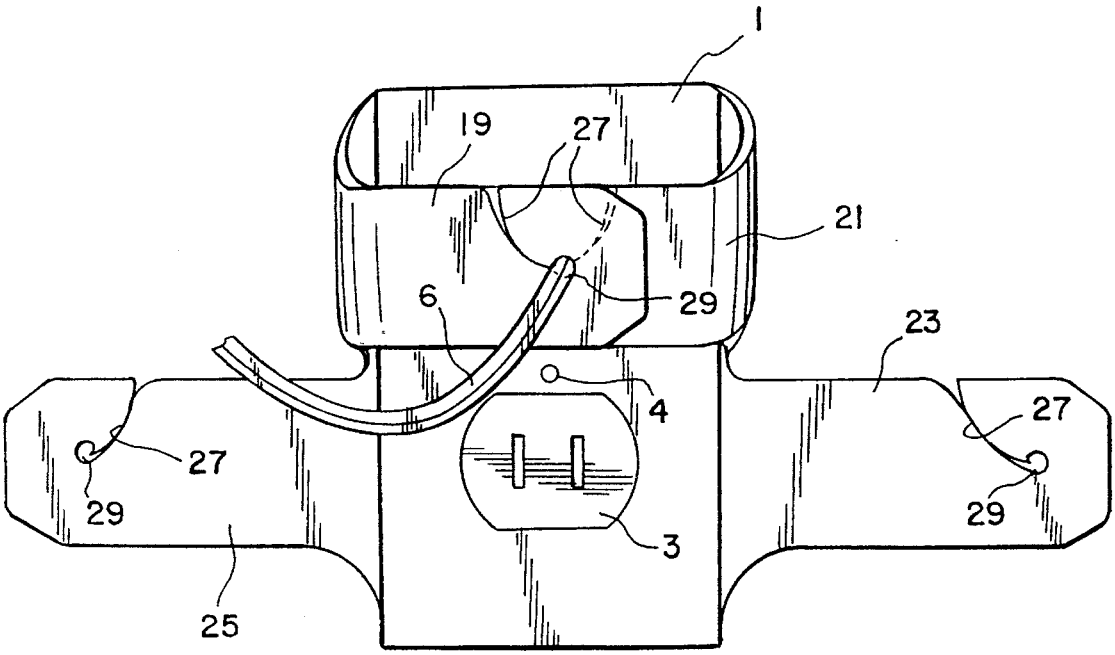
FIG. 4 shows a front view of the device as shown in Figure 3.

As seen in FIGS. 3 and 4, the flexible, wing-like structures 19 are folded over toward the center of the electrical receptacle cover 1 and the electrical cord 6 is inserted within the opening 29 of each of the wing-like structures 19 and 21, respectively, to aid in retaining the male connector 5 within the female receptacle 2. The flexible nature of the wing-like structures 19, 21, 23 and 25 allows easy adjustment of their position along an electrical cord such as the electrical cord 6. As seen in FIG. 3, the wing-like structure 21 engages the rear of the plug 5 to hold it in connected position. If the plug 5 is made of a shallower configuration, a sleeve or flexible band may be installed over the electrical cord 6 to take up any slack between the structure 21 and the rear end of the plug 5 to thereby ensure firm retention of the plug 5 within the receptacle 2.

Figure 5:
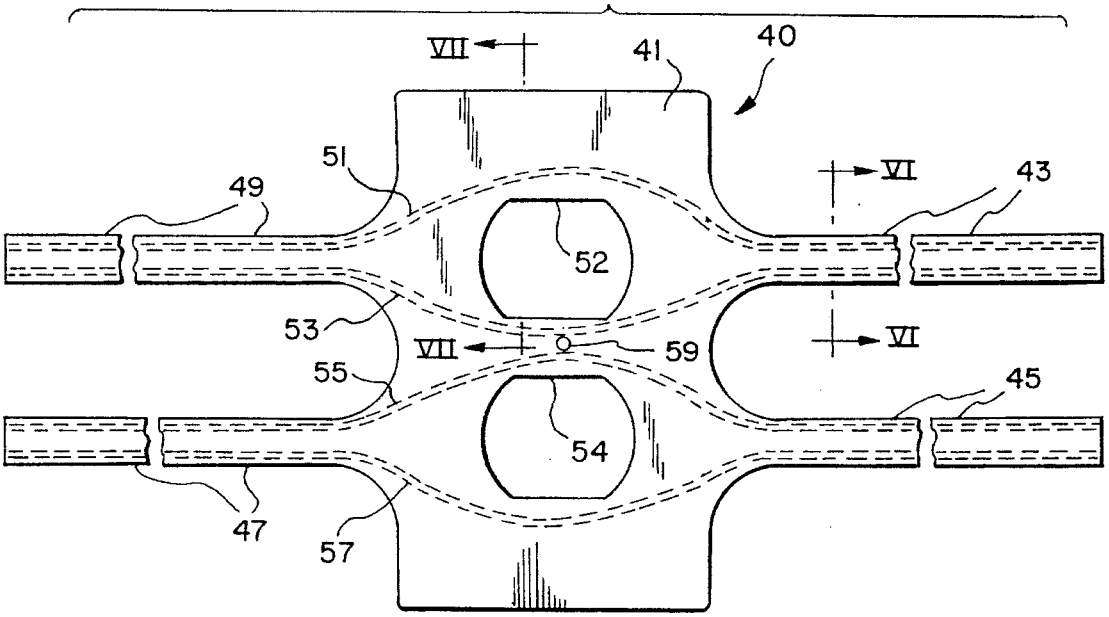
FIG. 5 shows a front view of a second embodiment of the present invention with portions of the structure thereof shown in phantom.
Figure 6:
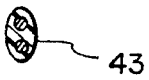
FIG. 6 shows a cross-sectional view along the line VI—VI of FIG. 5.
Figure 7:
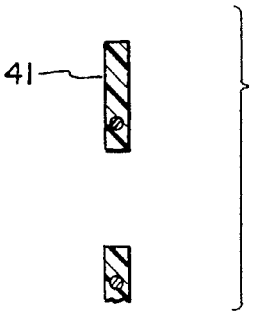
FIG. 7 shows a cross-sectional view along the line VII—VII of FIG. 5.

With reference, now, to FIGS. 5–7, a second embodiment of the present invention is generally designated by the reference numeral 40 and is seen to include a body 41 having the same general shape as the body 11 of the cord holding attachment 10. Strips or appendages 43, 45, 47 and 49 extend laterally outwardly from the body 41 as particularly shown in FIG. 5.

As shown in phantom in FIG. 5, stiffening wires 51, 53, 55 and 57 extend within the body 41 and outwardly within the strips 43, 45, 47 and 49. In the preferred construction of the device 40, the device 40 is molded with the stiffening wires 51, 53, 55 and 57 embedded therein at the time of molding.

As should be understood from the description of the first embodiment in FIGS. 1–4, the inventive cord holding attachment 40 is installed in conjunction with an electrical receptacle in the same manner as is the cord holding attachment 10 illustrated in FIGS. 1–4. In particular, the device 40 has an opening 59 which may be aligned with the opening 4 of an electrical receptacle cover 1 and which also aligns with a threaded opening (not shown) in the electrical receptacle so that a threaded fastener may be inserted through the opening 4 in the cover 1, through the opening 59 in the device 40 and thence threadably received within the threaded opening (not shown) of the electrical receptacle to retain the device 40 in mounted position in a manner corresponding to that which is shown in FIG. 2 concerning the device 10.

Thereafter, the strips 43, 45, 47 and/or 49 may be bent toward the center of the receptacle cover into engagement with an electrical cord where they may be tied thereto, wrapped therearound or otherwise removably fastened to the electrical cord to allow retention of the associated male electrical coupling in coupled relation to the female receptacle such as the female receptacle 2 or 3 as shown in FIG. 2.

If desired, it is possible to make the inventive device in the embodiment of FIGS. 5–7 by omitting major portions of the body 41 except those immediately surrounding the openings 52, 54 thereof. Alternatively, the pair of strips, for example, 43, 49 or 45, 47, may consist of an elongated double conductor wire which is split in the area where it must surround the female receptacle such as the female receptacle 2 or 3 as illustrated in FIG. 2.

Additionally, if desired, the strips 43, 45, 47 and 49 may be provided with any suitable attachment means to facilitate attachment to the electrical cord. These attachment means may include hook and pile fastening means ("VELCRO"), snap fasteners, or any other suitable device.

To deter undesired uncoupling of an electrical cord from its receptacle, one flexible elongated appendage may be attached thereto using appropriate attaching means such as, for example, the slot 27 and opening 29 shown in FIG. 1.

As such, an invention has been disclosed in terms of preferred embodiments thereof which fulfill each and every one of the objects of the invention as set forth hereinabove and provide a new and improved cord holding attachment for electrical receptacle of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved cord holding attachment adapted for installation in conjunction with an existing electrical receptacle having a cover plate attached thereover, the cover plate including a first side edge and a second opposed side edge, said cord holding attachment comprising:

a) a body having first and second sides and attachable under the cover plate of the electrical receptacle, said body extending under the cover plate continuously from said first side to said second side thereof, said first and second sides edges of the cover plate aligned with the first and second sides of said body;

b) at least one flexible elongated appendage integrally formed with said body and extending laterally outwardly from at least one of said sides, said at least one flexible appendage being flexed inwardly over the cover plate and having means at a distal end of said flexible appendage attachable to an electrical cord coupled with the electrical receptacle to deter undesired uncoupling thereof.

2. The attachment of claim 1, wherein said at least one flexible appendage has at least one stiffening member embedded therein.

3. The attachment of claim 2, wherein said at least one stiffening member comprises a wire.

4. The attachment of claim 2, wherein said at least one flexible appendage is thin.

5. The attachment of claim 2, wherein said at least one appendage comprises two appendages, each appendage extending laterally outwardly from one of said sides of said body.

6. The attachment of claim 1, wherein said means at said distal end comprises a slot therein adapted to releasably receive the electrical conductor.

7. The attachment of claim 1, wherein said at least one appendage comprises two appendages, each appendage extending laterally outwardly from one of said sides of said body.

8. The attachment of claim 1, wherein said body is generally rectangular and has an opening therethrough sized to closely surround a female receptacle of the existing electrical receptacle.

9. The attachment of claim 8, wherein said body has a plurality of openings said existing electrical receptacle comprising two electrical receptacles, each of said electrical receptacles being surrounded by one of said openings.

10. The attachment of claim 9, wherein said body has one mounting screw opening, said one mounting screw opening being sized to receive therein a cover plate screw.

11. The attachment of claim 3, wherein said stiffening member comprises a plurality of wires.

12. The attachment of claim 1, said body being made of flexible plastic.

13. The attachment of claim 1, said body being made of rubber.

14. The attachment of claim 1, wherein at least one of said appendages is reinforced with a stiffening member.

15. The attachment of claim 14, wherein said stiffening member comprises a plurality of wires.

* * * * *